US005685633A

United States Patent [19]

Engel

[11] Patent Number: 5,685,633

[45] Date of Patent: Nov. 11, 1997

[54] LAMP FOR ELONGATE LIGHTING MEANS

[76] Inventor: Hartmut S. Engel, Monrepos Strasse 7, Ludwigsburg, Germany, 71634

[21] Appl. No.: 452,918

[22] Filed: May 26, 1995

[30] Foreign Application Priority Data

Dec. 8, 1994 [DE] Germany ..... 44 43 741.2

[51] Int. Cl.[6] ..... F21S 3/00

[52] U.S. Cl. ..... 362/223; 362/290; 362/354

[58] Field of Search ..... 362/223, 224, 362/260, 290, 291, 292, 300, 354, 342

[56] References Cited

U.S. PATENT DOCUMENTS

| | | | |
|---|---|---|---|
| 1,953,004 | 3/1934 | Muller | 362/291 |
| 2,143,148 | 1/1939 | Guth | 362/291 |
| 3,152,277 | 10/1964 | Cutler et al. | 362/260 |
| 3,179,797 | 4/1965 | Franck | 362/223 |
| 4,006,355 | 2/1977 | Shemitz et al. | 362/290 |

*Primary Examiner*—Y My Quach

*Attorney, Agent, or Firm*—Townsend and Townsend and Crew LLP

[57] ABSTRACT

A lamp for elongate lighting means in which the respective lighting means is arranged in the inner space of a flat, trough-like housing and an anti-dazzle unit is associated with the lighting means which consists of several mutually spaced apart grid surfaces of light permeable material which are likewise largely located in the inner space of the trough-like housing.

18 Claims, 6 Drawing Sheets

LAMP FOR ELONGATE LIGHTING MEANS

BACKGROUND OF THE INVENTION

1. Technical Field

The invention relates to a lamp for elongate lighting means, such as for example fluorescent lamps, comprising a flat trough-like housing in which are held at least one curved reflector which extends over the whole base area of the housing and up to two mutually oppositely disposed edges defining the opening plane of the housing, at least one lighting means holder and an anti-dazzle unit associated with the lighting means.

2. Description of the Prior Art

A lamp of this kind is for example known from EP 0538727 A1. In the known lamp, a semi-cylindrically formed perforate metal sheet is provided as the anti-dazzle unit or as the anti-dazzle protection and surrounds the lighting means which is disposed outside of the opening plane of the housing. The interior or outer side of the perforated metal sheet is covered with a light permeable foil, so that the perforated metal sheet and the foil are supposed to form a substitute for opaque or milky half-shells.

SUMMARY OF THE INVENTION

The object underlying the invention is to so develop a lamp of the initially named kind that the use of the shallowest possible housing is made possible, i.e. of a housing having a low depth, and so that an ideal light exploitation with the most uniform radiant intensity per unit area possible is obtained over the entire opening surface of the lamp while precluding disturbing dazzling effects.

This object is satisfied in accordance with the invention in that the elongate lighting means is arranged within the inner space surrounded by the housing and is positioned associated with the respective region of the strongest reflector curvature; and in that the anti-dazzle unit consists of a plurality of mutually spaced grid surfaces of light permeable material which are preferably arranged on both sides of the lighting means and extend outwardly at least partly beyond the opening area of the housing.

Through the use of grid surfaces of light permeable material, in particular of plastic material, it is possible, on the one hand, to achieve the required smoothing out of the radiant intensity per unit area and, on the other hand, to minimize the lateral light loss, so that a maximum exploitation of the light is achieved. In this respect, it is particularly advantageous that the division of the grid at the grid surfaces which is present practically does not enter into appearance, and indeed not even when looking at the light from the side, because the light is uniformly distributed in the grid surfaces consisting of plastic or glass, so that those regions of the anti-dazzle unit, which are not directly irradiated by the lighting means, have a correspondingly adapted radiant intensity per unit area.

The grid structure provided at the grid surfaces is preferably manufactured by extrusion, and in this way, different cross-sectional structures of the ribs and recesses which are thereby formed can be realized. Grid systems manufactured in a first step with throughgoing ribs can be modified by a further processing step, in particular by a further pressing step in such a way that individual elements, for example in the form of individual pyramids, are provided if a grid structure of this kind is required.

Basically, it is also possible to avoid such structuring, that is to say the use of a prismatic structure when, for example, lightly colored, opaque plastics are provided as the anti-dazzle elements, such as is entirely possible for certain applications.

The grid surfaces are preferably arranged parallel to one another and connected with one another by transverse webs which likewise conduct light, so that compact units arise in which the number of the mutually parallel grid surfaces is selected in dependence on which radiant intensity per unit area is required in an adaptation to the radiant intensity from the reflector at the outwardly disposed grid surfaces.

The grid surfaces consisting of plastic or glass are smooth at their side facing the lighting means and are preferably corrugated or structured at their side remote from the lighting means because the light loss is very low through the prism which is formed in this way while avoiding dazzling effects, and thus a very intentional and defined matching of the radiant intensity per unit area is possible with the provision of a plurality of such grid surfaces.

It is of particular importance in the context of the invention that the individual reflector surfaces are asymmetrically curved, and indeed in such a way that the region of the most pronounced curvature is also located at the position where the lighting means is arranged, so that the lighting means is disposed in the focal region or directly adjacent to the respective focal region. In conjunction with the respective anti-dazzle unit this also provides the possibility, on the one hand, of obtaining a good yield of indirect light via the reflector and, on the other hand, of exploiting a predeterminable direct light component.

Through the arrangement of the lighting means in the inner space of the trough-like housing and the flat structure of the asymmetrical individual reflectors, a very compact and areal manner of construction is ensured which leads to comparatively large area lamps with uniform radiant intensity per unit area which satisfy all requirements with respect to freedom from dazzling and ideal light exploitation.

Through the combination of lights in accordance with the invention, with the same or differing radiation characteristics, and by predetermining specific spacings during the installation of these lamps, it is possible to achieve ideal light distribution curves for the particular application, with it being possible, in problem-free manner, to provide a uniformly lit total room area or preferentially lit regions of the respective room, in particular the center of the room, or to provide a reflection-free region in particular in the centre of the room and to illuminate the edge regions more strongly.

Further advantageous developments of the invention are set forth in the subordinate claims and will be explained in the following with reference to embodiments and to the drawing.

DESCRIPTION OF THE PREFERRED EXEMPLARY EMBODIMENTS

Figure 1:
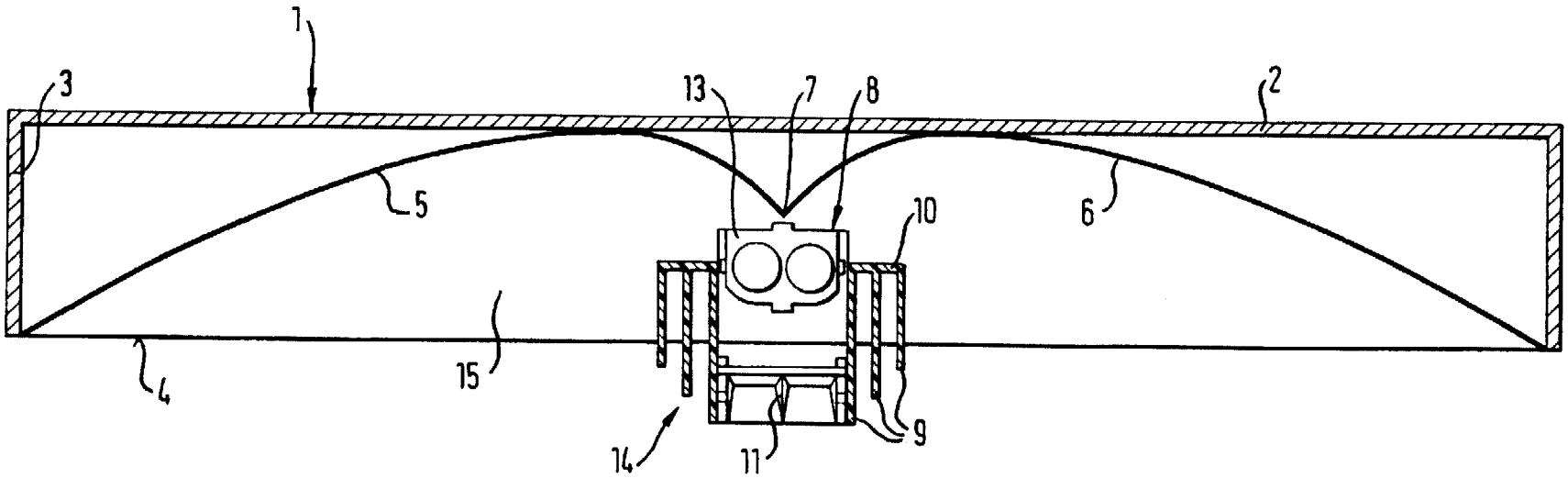
FIG. 1 is a schematic cross-sectional illustration of a first embodiment of a lamp in accordance with the invention.

FIG. 1 shows a rectangular housing formed in the shape of a flat trough having a housing base 2 and side walls 3 and which can be secured to a ceiling or preferably however built into or integrated into a ceiling, in particular a louvered or cassette ceiling.

The opening cross-section of the housing 1 is characterized with the reference numeral 4 and in the inner space 15 of the housing 1 there are accommodated both the reflectors 5, 6 and also the lighting means 8 with the associated anti-dazzle unit 14, with the anti-dazzle unit 14 extending at least partly beyond the opening surface 4 of the housing.

The two reflectors 5, 6 extend over the entire cross-section of the housing and are centrally symmetrically arranged, so that a type of wing structure arises through the two reflectors 5, 6. The reflectors 5, 6 are flushly secured in the region of the outer edges of the oppositely disposed side walls 3 of the housing and have only a very low curvature. The curvature increases towards the center of the housing 1, with the reflectors 5, 6 preferably contacting the base 2 of the housing adjacent to the center and then being continued on with stronger curvature towards the center where they meet at a connection edge 7 which is disposed in the upper half of the inner space 15 of the housing 1.

Directly adjacent to this connection edge 7 and likewise centrally symmetrically arranged is the lighting means or the fluorescent lamp 8 which, in the case of a light with a socket at one side is held in a holder 13 which is mounted on one side wall 3.

An anti-dazzle unit 14 which is formed from several grid surfaces 9 consisting of glass or plastic is associated with the lighting means 8 and arranged directly adjacent this lighting means 8. These grid surfaces 9 are held together via transverse webs 10 of the same material and extend perpendicular to the base of the housing 2 outwardly from the center of the inner space 15 of the housing 1. The grid surfaces 9 extend parallel to one another and have different lengths for the formation of a stepped structure. In this way, anti-dazzling or dimming effects which differ with respect to the angle of viewing can be achieved and indeed having regard to the uniform radiant intensity per unit area which is sought over the entire opening cross-section 4.

In the free central space between the two grid surfaces disposed to the side of the lighting means 8 there is mounted an open grid 11, so that direct radiation is achieved in this central region, again while precluding dazzling effects, while an ideal light irradiation onto the reflectors 5 and 6 is achieved at the reflector side. With the open grid 11 one can utilize a square, rectangular or round grid which is preferably manufactured of light permeable material, for example plastic material.

The anti-dazzle unit 14 is thereby simultaneously exploited as a carrier for the open grid 11 and a sliding guide, snap-latch connections or another clamped connection can be formed between these two units.

Figure 2:
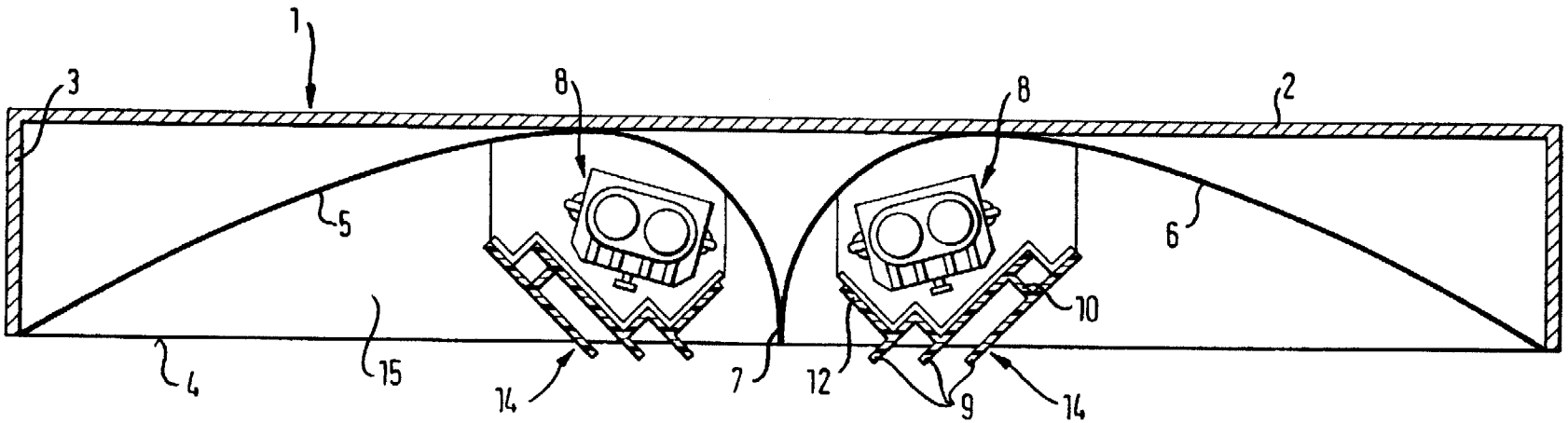
FIG. 2 is a schematic illustration of a second embodiment.

The embodiment of FIG. 2 shows a centrally symmetrical light with two lighting means 8 which are arranged separate from one another in a common housing 1. An alternative embodiment would have only one reflector, as opposed to two reflectors.

In the embodiment of FIG. 2, the two reflectors 5, 6, which are again asymmetrically formed, are drawn forwardly from the center up to the opening surface 4 of the housing 1; that is to say, the connection edge 7 lies approximately in the area of the cross-sectional opening of the lamp. The lighting means 8 are disposed approximately at the focal point regions of the reflectors, and the respectively associated anti-dazzle unit is so formed and positioned that once again the direct and indirect light radiation is achieved and a balanced radiant intensity distribution is achieved.

The grid surfaces 9 consisting of glass or plastic extend at an angle of approximately 45° to the base surface 2 of the housing and extend only fractionally beyond the opening area 4 of the housing. The two grid surfaces 9 which are parallel to one another are connected via transverse webs 10. A further grid surface is molded onto the grid surface 9 disposed towards the center of the housing and extends at right angles thereto up to and into the vicinity of the respective reflector 5, 6, but leaves a gap open with respect to the respective reflector. Through this anti-dazzle unit, a direct visible contact with the respective lighting means 8 is precluded and it is ensured that a very uniform luminous intensity is obtained over the entire light surface.

Through the layout and relative arrangement of the lighting means 8, reflectors 5, 6, and anti-dazzle unit 14, only very small air flows arise in the lamp, which has the consequence that disturbing depositions of contamination on the reflector or on the reflectors can be avoided.

Figure 3:
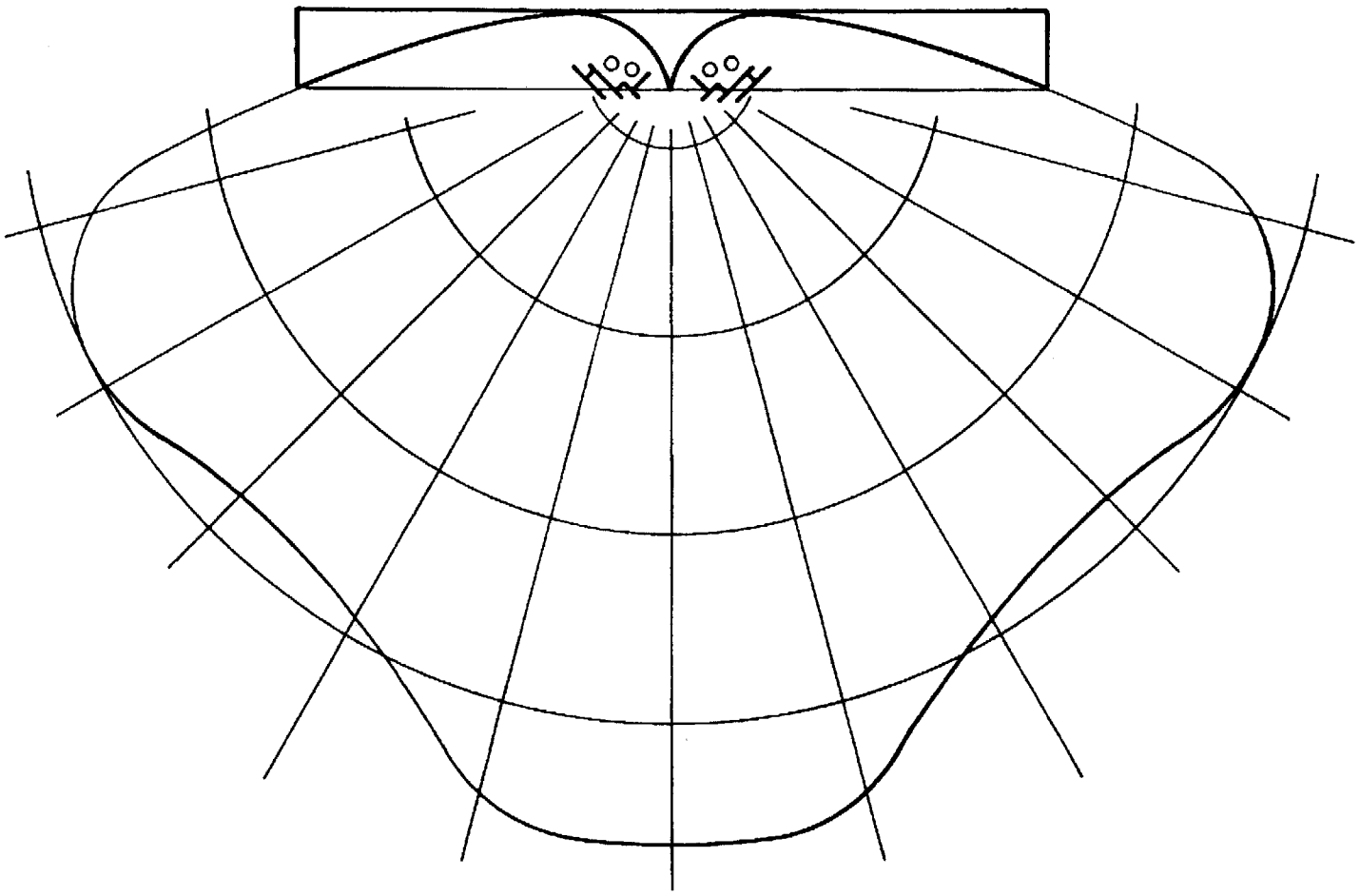
FIGS. 3–6 are examples of light distribution curves or room lighting situations which can be realized with lamps in accordance with the invention.

FIG. 3 shows in schematic manner the light distribution curve for a lamp arrangement in accordance with FIG. 2. The light distribution realized in this manner is in particular suitable for those cases in which the center of the respective room should be preferentially lit and little light is desired in the wall region, as is for example the case with rooms having glass facades.

Figure 4:
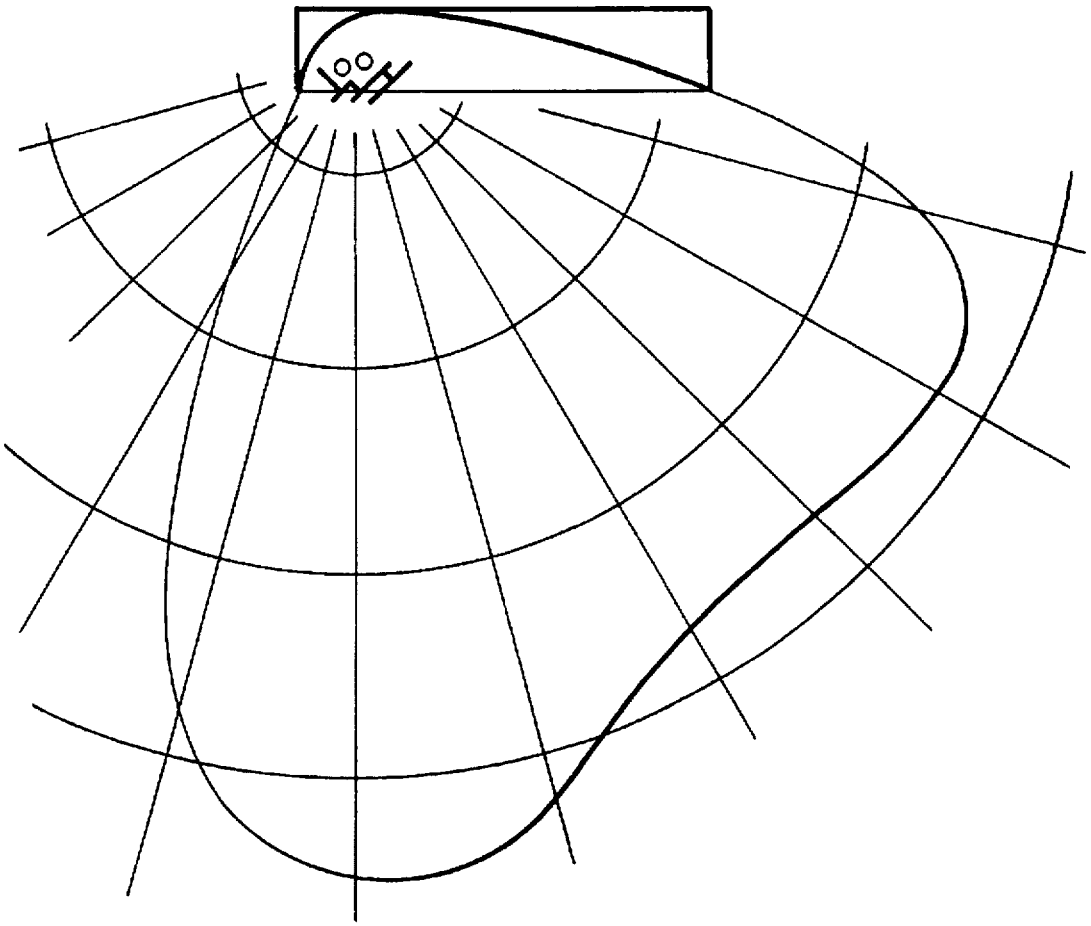

FIG. 4 shows a light distribution curve which can be achieved with the base unit of the double arrangement shown in FIG. 2. Through corresponding positioning of these lamps in combination with further lamps having a similar and also different light distribution curve, room lighting matched to the individual circumstances can be achieved.

Figure 5:
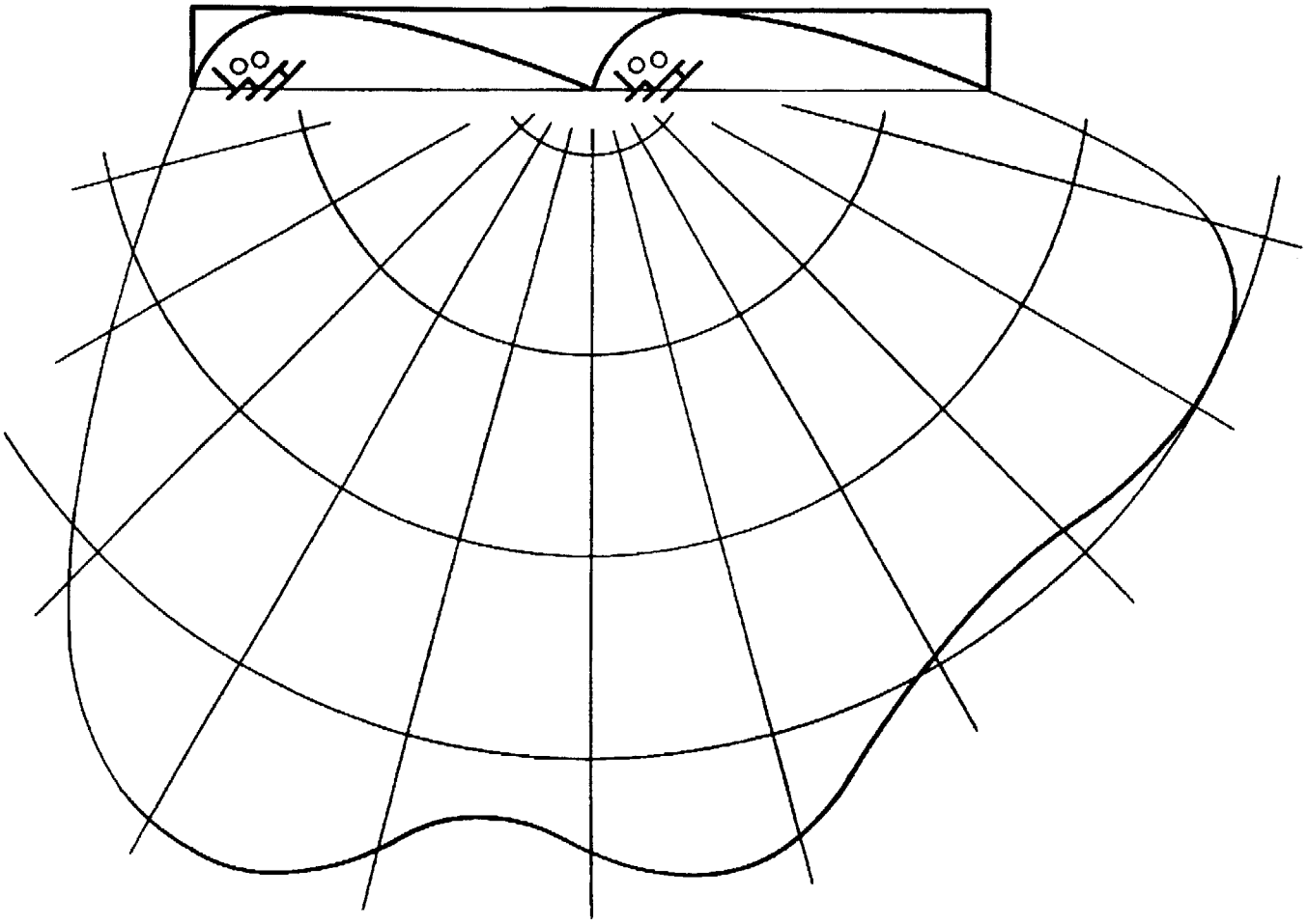

FIG. 5 shows a light distribution curve of a double lamp in accordance with the invention which is suitable for achieving a higher light requirement over a larger room area. If, for example, two such lights are arranged mutually spaced apart and mirror-symmetrically relative to the center of the room, then it is possible to leave the central region of the ceiling of the room relatively dark and peaceful, whereas in the center of the room, the required higher light requirement can be met, while simultaneously the walls of the room can remain relatively dark as a result of the radiation characteristic that is present.

Figure 6:
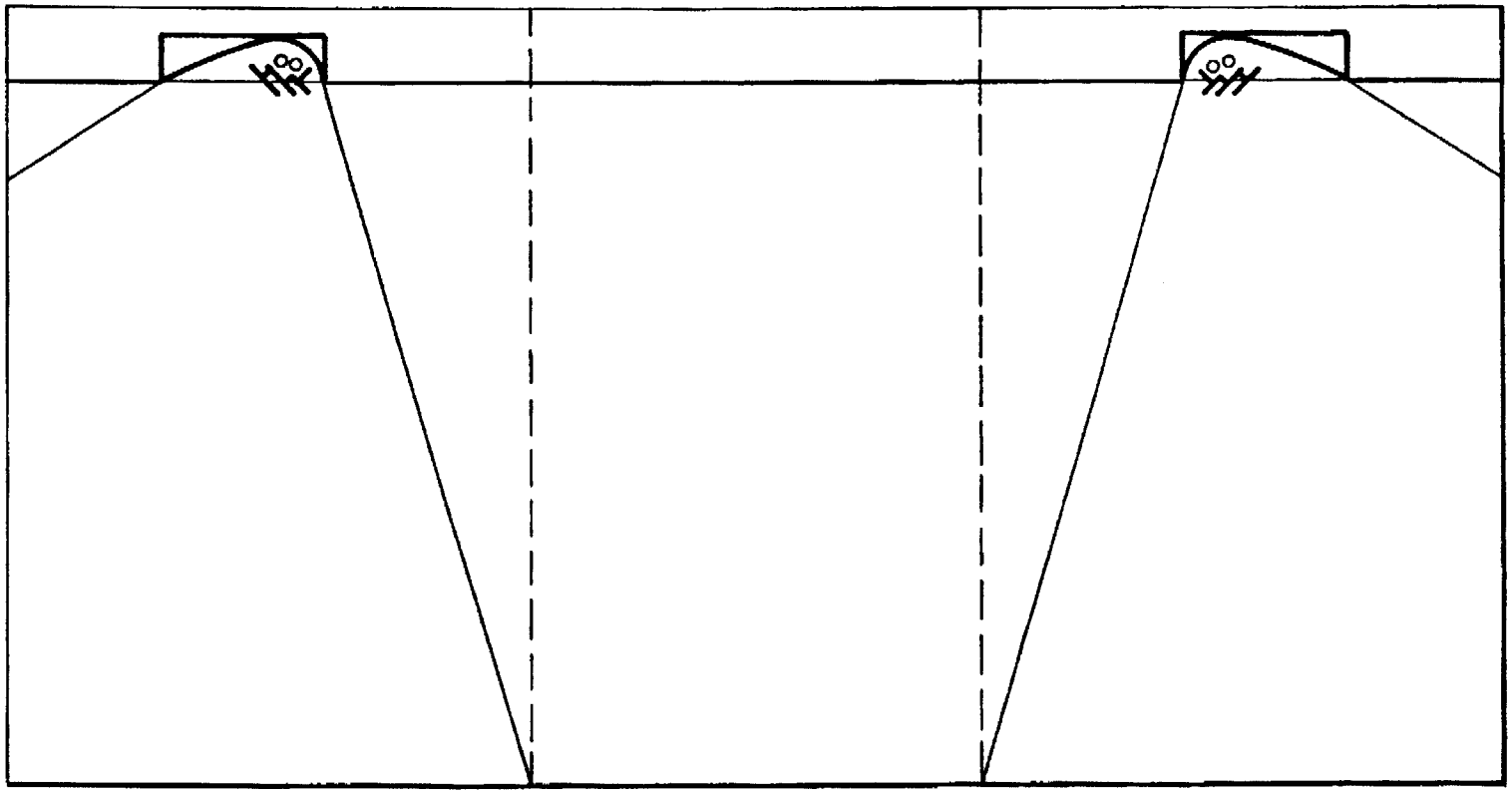

The schematic illustration of FIG. 6 shows the cooperation of two lights having the light distribution curve shown in FIG. 4. In this case, it is possible to brightly light the walls of the room, such as is for example desired for luxury rooms. Through the cooperation of the lamps in accordance with the invention shown in FIG. 6, it is however above all possible to provide a practically reflection-free center in the room which facilitates the erection of screens, e.g. such as the screens of computer terminals, and provides good working conditions from the point of view of technical lighting.

If higher luminous intensities are required, then instead of the single arrangements shown in FIG. 6, double lamps can be used of the kind shown in FIG. 5.

Through the examples explained with respect to FIGS. 3–6 it is clear that the lighting tasks which arise in practice can be ideally satisfied by the lamps formed in accordance with the invention, and in particular by combinations of similar or also dissimilar embodiments. This is so because, depending on particular requirement, both uniform room lighting and also differentiated room lighting can be realized and in doing so the particular lighting requirement can always be taken into account.

What is claimed:

1. Lamp for elongate lighting means, the lamp comprising a flat trough-like housing in which is held at least one curved reflector which extends over an entire base area of the housing and up to two mutually oppositely disposed edges in an opening plane of the housing, at least one lighting means holder and an anti-dazzle unit associated with the lighting means; wherein the elongate lighting means is arranged within an inner space surrounded by the housing and is positioned such that it is associated with a respective region of strongest reflector curvature; and wherein the anti-dazzle unit consists of a plurality of mutually spaced grid surfaces of light permeable material which are arranged on both sides of the lighting means and extend outwardly at least partly beyond the opening area of the housing, the grid surfaces only partially extending toward the two mutually disposed edges.

2. Lamp in accordance with claim 1, wherein the grid surfaces consisting of light permeable material extend along the lighting means between two mutually oppositely disposed side walls of the housing, are arranged parallel to one another, and are connected together via at least one transverse web which likewise consists of light permeable material.

3. Lamp in accordance with claim 1, wherein the grid surfaces which are arranged parallel to one another form a stepped structure.

4. Lamp in accordance with claim 1, wherein the grid surfaces are smooth at their side confronting the lighting means and are provided at their side remote from the lighting means with a prismatic structure.

5. Lamp in accordance with claim 1, wherein transverse webs which connect the grid surfaces are provided in a region of reflector side ends of the grid surfaces.

6. Lamp in accordance with claim 1, wherein the number of grid surfaces and their relative arrangement are so selected that at least substantially the same radiant intensity per unit area is present when considered over an opening area of the housing.

7. Lamp in accordance with claim 1, wherein two centrally symmetrically arranged reflectors are provided which are of increasingly curved shape going from the oppositely disposed edge regions of the housing towards a center; wherein the elongate lighting means is centrally arranged directly beneath a connecting edge of the two reflectors; and wherein two grid surfaces of the anti-dazzle unit are likewise centrally symmetrically arranged on both sides of the lighting means, with an open central region of the anti-dazzle unit forming a direct light outlet.

8. Lamp in accordance with claim 7, wherein an open rectangular grid is arranged in the direct light outlet and can consist of a light permeable material, and it is mounted on inwardly disposed, with respect to the housing, grid surfaces.

9. Lamp in accordance with claim 7 wherein an open square grid is arranged in the direct light outlet and can consist of a light permeable material, and it is mounted on inwardly disposed, with respect to the housing, grid surfaces.

10. Lamp in accordance with claim 7 wherein an open round grid is arranged in the direct light outlet and can consist of a light permeable material, and it is mounted on inwardly disposed, with respect to the housing, grid surfaces.

11. Lamp in accordance with claim 1, wherein an asymmetrical reflector is arranged in the housing and extends between two mutually oppositely disposed housing edges, with the elongate light being arranged in its focal region and with the light being screened by a grid surface arrangement against direct visible contact.

12. Lamp in accordance with claim 1, wherein two centrally symmetrically arranged reflectors are provided in the housing and are shaped so that their curvature increases towards the center from the mutually oppositely disposed edge regions of the housing, with the reflectors being drawn forward in the central region of the housing to the opening plane while forming a connection edge; wherein a respective elongate lighting means is arranged in the focal region of each reflector; and wherein an anti-dazzle unit is associated with each reflector which consists of grid surfaces extending perpendicular to one another which at least substantially prevent direct viewing of the lighting means.

13. Lamp in accordance with claim 1, wherein the anti-dazzle units are mounted at their ends to end walls of the housing.

14. Lamp in accordance with claim 1, wherein prismatic structures are formed by extrusion and consist of continuous ribs formed by an additional pressing step.

15. Lamp in accordance with claim 1, wherein opaque plastics are used in place of a prismatic structure for the grid surfaces.

16. Lamp in accordance with claim 1 wherein prismatic structures are formed by extrusion and consist of individual elements formed by an additional pressing step.

17. Lamp in accordance with claim 16 wherein the individual elements are in the form of individual pyramids.

18. Lamp in accordance with claim 1 wherein opaque plastics are used in conjunction with a prismatic structure for the grid surfaces.

* * * * *